US006959515B1

(12) United States Patent
Beighton

(10) Patent No.: US 6,959,515 B1
(45) Date of Patent: Nov. 1, 2005

(54) BUILDING STRUCTURES

(76) Inventor: Ashley Thomas Beighton, Windsor Cottage, High Street, Deddington, Banbury (GB) OX15 0SL ( * ) Notice: Subject to any disclaimer, the term of this patent is extended or adjusted under 35 U.S.C. 154(b) by 0 days.

(21) Appl. No.: 10/031,327

(22) PCT Filed: May 17, 2000

(86) PCT No.: PCT/GB00/01892

§ 371 (c)(1),
(2), (4) Date: Jun. 27, 2002

(87) PCT Pub. No.: WO00/71825

PCT Pub. Date: Nov. 30, 2000

(30) Foreign Application Priority Data

May 21, 1999 (GB) ..... 9911946

(51) Int. Cl.[7] ..... E04H 1/00; E04H 9/00

(52) U.S. Cl. ..... 52/79.9; 52/79.4; 52/79.1; 52/79.12; 52/236.7; 52/474; 52/475.1; 52/476; 52/478; 52/481.2

(58) Field of Search ..... 52/79.1, 79.4, 52/79.9, 79.12, 236.7, 474, 483.1, 648.1, 52/475.1, 476, 478, 481.2, 768, 769, 773

(56) References Cited

U.S. PATENT DOCUMENTS

| | | | | |
|---|---|---|---|---|
| 3,541,744 | A | 11/1970 | Maxwell | |
| 3,788,024 | A * | 1/1974 | De Hartog | 52/648 |
| 3,791,080 | A * | 2/1974 | Sjoberg | 52/79.1 |
| 3,818,654 | A | 6/1974 | Schramm | |
| 3,905,167 | A * | 9/1975 | Watkins et al. | 52/79 |
| 4,592,175 | A * | 6/1986 | Werner | 52/79.9 |
| 4,612,741 | A * | 9/1986 | Jacobson | 52/79.4 |
| 4,766,708 | A | 8/1988 | Sing | |
| 4,854,094 | A * | 8/1989 | Clark | 52/79.1 |
| 5,402,608 | A * | 4/1995 | Chu | 52/79.1 |
| 5,678,375 | A * | 10/1997 | Juola | 52/655.1 |
| 5,829,212 | A * | 11/1998 | McKeag et al. | 52/236.3 |

FOREIGN PATENT DOCUMENTS

| | | |
|---|---|---|
| DE | 2 306 865 | 8/1974 |
| FR | 2 444 130 | 11/1980 |

* cited by examiner

*Primary Examiner*—Jeanette E. Chapman
(74) *Attorney, Agent, or Firm*—ipsolon llp

(57) ABSTRACT

A building structure comprising: a support module; and one or more room modules, the or each room module being attachable to and cantilevered from the support module. The room modules are independently attached to the support module to allow independent removal or addition of room modules.

25 Claims, 13 Drawing Sheets

BUILDING STRUCTURES

THIS INVENTION relates to improvements in or relating to building structures and more particularly to a modular building structure and method of producing the same.

The construction of any building such as a house, factory or the like typically involves the laying of a foundation, such as the establishment of footings to define the floor plan and room arrangement, the building of structural walls and the provision of a roof structure. A single building contractor would usually undertake all of this work although some aspects may be contracted out either by the contractor or by the principal. Once this work is completed, or in parallel therewith, other contractors will normally be involved in the building work such as plumbers, electricians, joiners, plasterers and decorators. It can therefore be appreciated that not only is this work being carried out in one location, but also that a great many contractors are required to produce a single building. This results in a complicated process since there are typically many lines of communication necessary and there is often significant overlap and conflict in both the working areas required for each trade and in the responsibility for various jobs.

Prefabricated building methods can be employed when it is desirable to move either all or a proportion of the work off-site. These methods broadly fall into two categories: pre-fabricated components and pre-fabricated 'volumetric' modules. The use of either technique can be applied to a greater or lesser extent in any building depending on the relative importance of factors such as programme time, location, cost and quality. In addition, the degree to which the component or 'volumetric' module is itself prefabricated will be affected by similar factors.

Examples of such components may range from doors and windows to floor and wall panels. Examples of 'volumetric' modules may range from bathroom modules used in buildings such as hotels to fully finished houses.

The application of all of the above techniques results however in the building of a complete structure which, once completed, is substantially set in its size, design and configuration.

It is an object of the present invention to provide an improved building structure and method of producing the same which offers a building having a flexible size, design and configuration. It is a further object to provide a building having rooms which are replaceable and can therefore be readily upgraded to a higher specification or their functionality changed.

Accordingly, one aspect of the present invention provides a building structure comprising: a support module; and a plurality of enclosed room modules, each room module being independently attachable to and cantilevered from the support module.

Advantageously, the support module supports one room module adjacent another, the room modules being horizontally spaced apart from one another.

Preferably, each room module is spaced apart from the or each adjoining room module.

Conveniently, a cladding is provided around the building structure.

Advantageously, the cladding is attached to and supported by a foundation.

Preferably, the foundation is formed from more than one element.

Conveniently, the cladding is attached to and supported by a roof structure.

Advantageously, the cladding is attached to and supported by at least one room module.

Preferably, the cladding comprises a plurality of demountable panels.

Conveniently, the support module supports a roof structure which covers the support module and each room module, the roof structure being spaced apart from the or each adjoining room module.

Advantageously, the roof structure includes a room module.

Preferably, a foundation structure underlies the support module, the foundation structure being spaced apart from the or each adjoining room module.

Conveniently, the foundation structure has a main portion upon which the support module sits and one or more stabilising portions extending from the main portion.

Advantageously, the main portion is a foundation slab.

Preferably, the or each stabilising portion underlies one or more room modules and is spaced apart from the or each adjoining room module.

Conveniently, the stabilising portion comprises a frame of foundation material having an outer perimeter, the centre of the frame being a void.

Advantageously, the foundation structure is manufactured as a precast concrete structure.

Preferably, one or more piles extend from the foundation structure into the underlying ground.

Conveniently, a room module is formed from panels which are linked together without a supporting frame.

Advantageously, a room module comprises a chassis defining a volume, the chassis having attachment means to co-operate with corresponding attachment means provided on a chassis of the support module.

Preferably, panels are provided between the members of the chassis to provide side walls, a floor and a ceiling.

Conveniently, the chassis is constructed from one or more upper and lower members connected rigidly by upright members but not braced by diagonal members, the rigidity of the chassis being secured by rigidity at the chassis joints.

Advantageously, a room module includes one or more internal partitions to define one or more rooms in each room module.

Preferably, a room module includes at least one door aperture.

Conveniently, a room module includes at least one window aperture.

Advantageously, the support module comprises a load bearing chassis having attachment means to co-operate with corresponding attachment means provided on a chassis of a room module.

Preferably, the attachment means on the support module comprises an array of spaced apart attachment locations provided along a chassis member of the support module, each of which attachment locations is suitable for co-operation with and attachment to corresponding attachment means provided on a chassis of a room module, the position of attachment of the room module with respect to the support module being variable by attaching the room module at different locations along the chassis member of the support module.

Conveniently, the attachment means comprise a plurality of holes formed in the chassis of the support module and the room module, the holes being alignable to receive therethrough a locking bolt to secure the room module to the support module.

Advantageously, the support module includes a circulation passage having access to each room module attached thereto.

Preferably, a further support module is attachable on top of the support module to provide a further storey to the building structure.

Conveniently, a further support module is attachable adjacent the support module to provide a plurality of support members in side by side engagement.

Advantageously, the services for the building are principally routed through the support module, thereby facilitating the connection of services to each room module attached to or attachable to the support module.

Preferably, each room module has services fitted in preparation for connection to corresponding services on the support module.

Conveniently, the or each support module has demountable wall panels, the wall panels being blank panels for walls of the support module which do not require an aperture therein and wall panels having an aperture therein for walls of the support module which do require an aperture therein, an aperture in a wall panel of the support module being alignable with an aperture in a wall panel of a room module.

Another aspect of the present invention provides an enclosed room module for independent cantilevered attachment to a support module.

A further aspect of the present invention provides a method of building a building structure comprising the steps of: presenting a plurality of enclosed room modules for independent cantilevered attachment to a support module; and attaching each room module to the support module for support thereby.

Advantageously, the step of attaching each room module to the support module comprises the steps of: attaching one or more guide rails to the support module; locating the room module on the guide rail; driving the room module along the guide rail into engagement with the support module; and attaching the room module to the support module.

Preferably, the step of attaching each room module to the support module comprises the steps of: attaching one or more guide rails to the support module; locating the room module on the guide rail; detaching the room module from the support module; and driving the room module along the guide rail away from the support module.

Another aspect of the present invention provides a kit for building a building structure, comprising: a support module; and a plurality of enclosed room modules, each room module being independently attachable to the support module such that it is cantilevered therefrom.

In order that the present invention may be more readily understood, embodiments thereof will now be described, by way of example, with reference to the accompanying drawings, in which.

Figure 1:
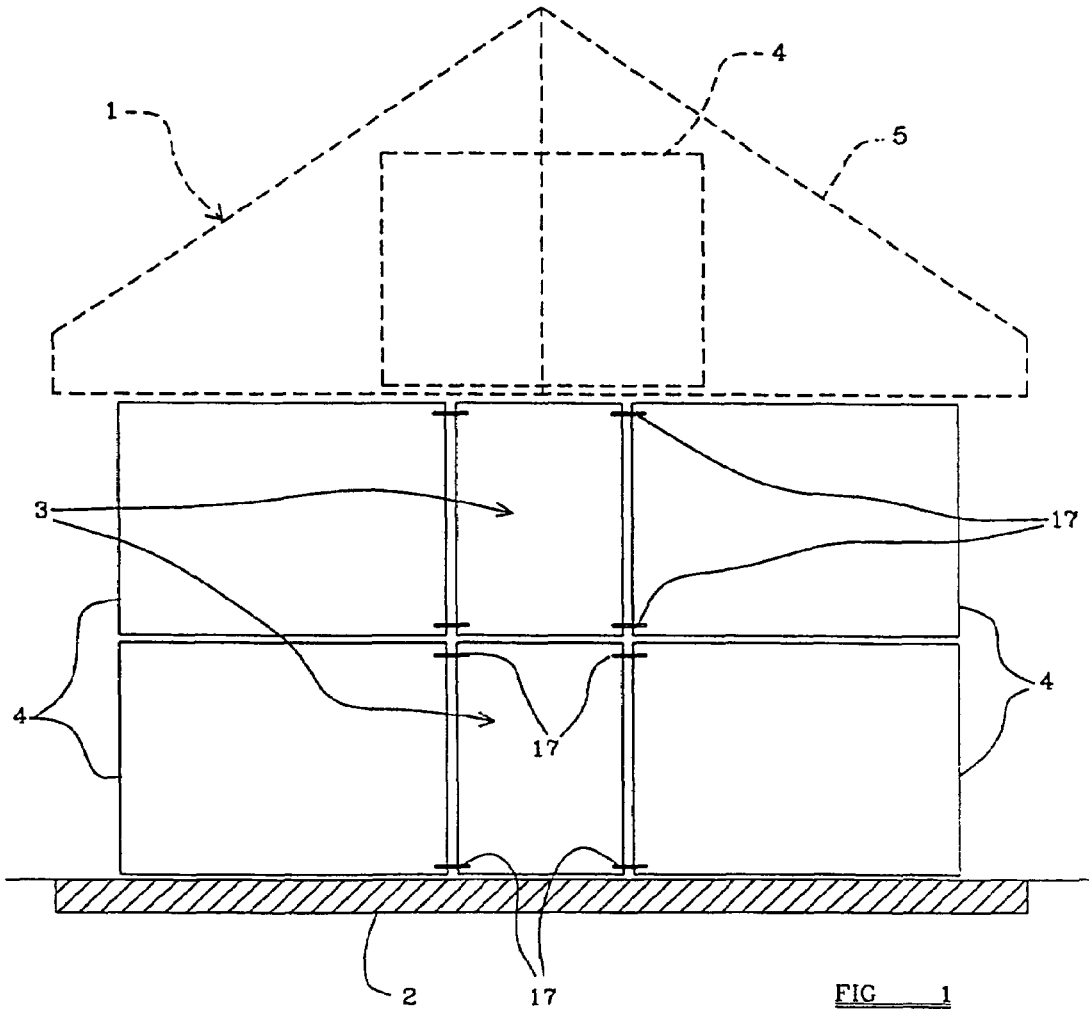
FIG. 1 is a schematic sectional view through a building embodying the present invention.

Referring to FIG. 1, a house 1 embodying the present invention comprises four basic components: a foundation 2 for providing a solid base and bearing the load of the building; two support modules 3 comprising the main load bearing elements of the building itself; a plurality of room modules 4 comprising the main living spaces in the building; and a roof structure 5.

Figure 2:
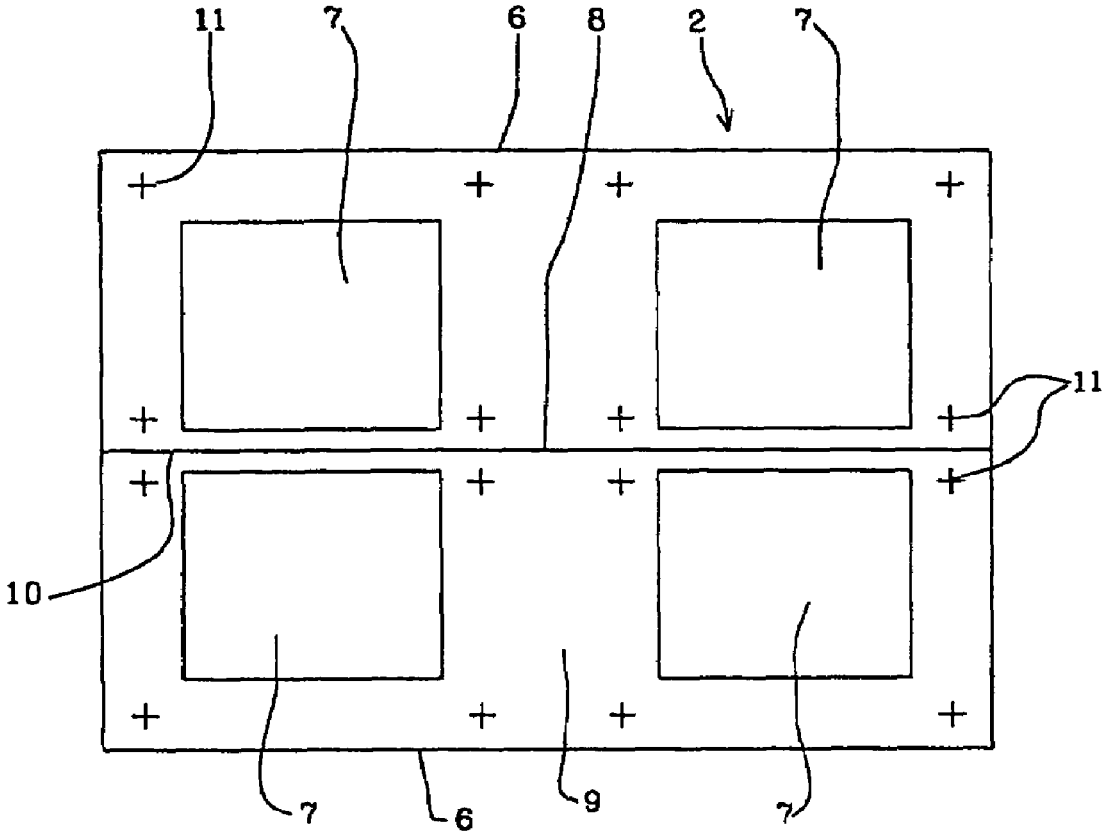
FIG. 2 is a schematic plan view of a foundation for use with the building of FIG. 1.
Figure 3:
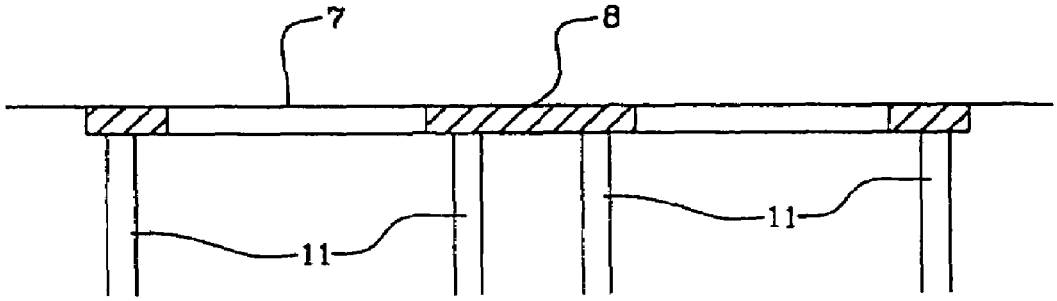
FIG. 3 is a schematic side view of the foundation of FIG. 2.

Turning to FIGS. 2 and 3, the foundation 2 comprises two rectangular precast concrete foundation slabs 6 which when positioned as shown create a foundation 2 having voids 7 in each corner to create a central main portion 8 of cruciform configuration. The support module 3 sits on one arm 9 of the cruciform and the other arm 10 of the cruciform provides a stabilising function. The frames of the voids 7 in the foundation slabs also provide a stabilising function.

Precast concrete piles 11, for example, are driven into the ground either before the foundation slab 2 is positioned or through holes provided in the foundation slab 2 at each of the corners of the voids 7.

The support module comprises a chassis or frame defining a substantially cuboid volume. The chassis is preferably manufactured from steel but other conventional load bearing materials can be used. The chassis is created from a plurality of upright and horizontal members which may be cross braced if required. Joints between the members which make up the chassis are rigid. The support module has panels, some of which may be demountable, which provide the walls, floor and ceiling.

The wall panels are blank panels for walls of the support module which do not afford access to the outside and whatever room modules are attached to the support module. The wall panels which do afford access to the outside or to room modules have a door aperture therein.

The outer surfaces of the support module are fitted with attachment means to allow room modules to be attached thereto. In a preferred example, the attachment means on the support module comprises a series of spaced apart arrays of holes provided in a horizontally oriented chassis member toward the ceiling of the support module. A second set of such attachment means are provided along a horizontally oriented chassis member toward the floor of the support module. Each of the arrays of holes is suitable for co-operation with and attachment to a corresponding array of holes provided on a chassis of a room module, the position of attachment of the room module with respect to the support module also being variable by attaching the room module at different locations along the chassis member of the support module. It is envisaged that either the position of the attachment means may be variable or that further attachment means may be provided intermediate or above or below the existing attachment means to allow flexibility of design.

In the present example, the building 1 includes two support modules 3 stacked on top of one another. These support modules 3, 3' may be assembled on-site, or off-site for delivery to the site. Access to the upper support module 3' is provided by a flight of stairs in the lower support module 3. Support modules may, however, be ganged together in a variety of configurations, thereby allowing a number of possible different floor plans for a building.

Although the support module 3 is described here as defining a substantially cuboid volume, the support module 3 may also be planar, having substantially no volume and being, for example, a supporting wall or face.

Figure 4:
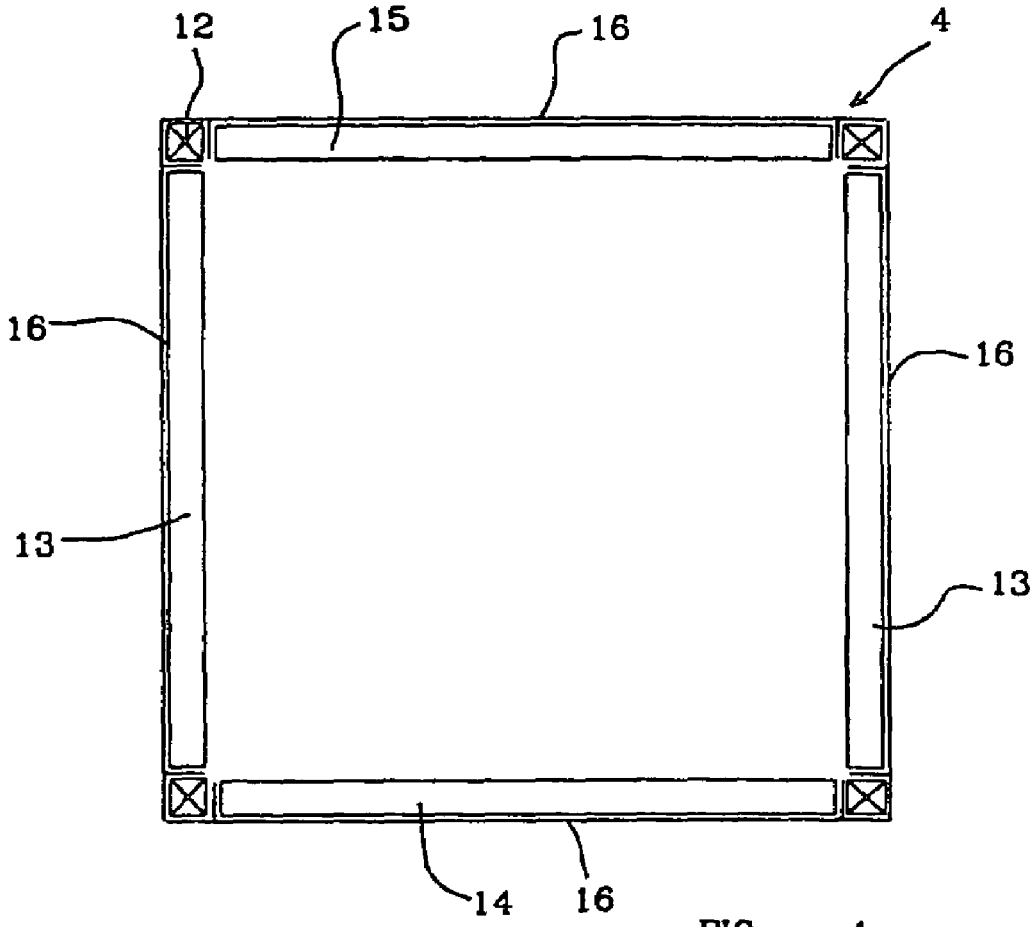
FIG. 4 is a schematic sectional view through a room module for use with the building of FIG. 1.

As previously explained, a plurality of room modules 4 are attachable to each of the support modules 3. These room modules 4 may be assembled on-site, or off-site for delivery to the site. Referring to FIG. 4, an exemplary room module 4 comprises a steel chassis 12 defining a substantially cuboid volume. The chassis is constructed from a plurality of upper and lower members connected rigidly by upright members but not braced by diagonal members, the rigidity of the chassis being secured by rigidity at the chassis joints.

Figure 4A:
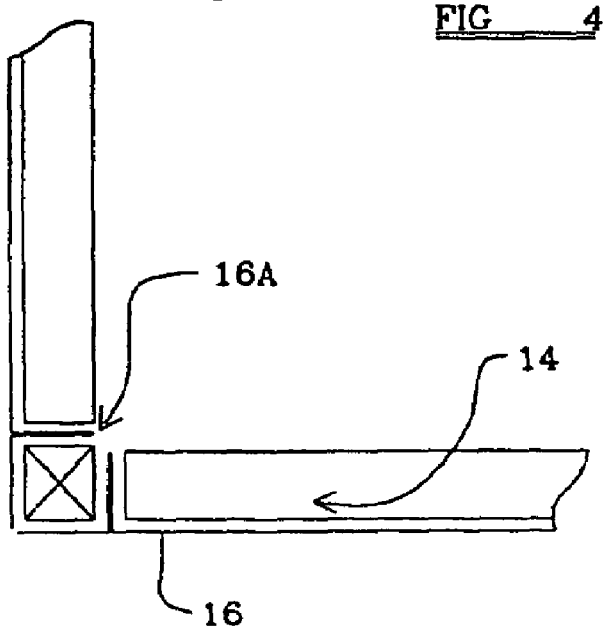
FIG. 4A is an enlarged detail of a portion of the room module of FIG. 4.

Panels are provided between the structural members of the chassis 12 to provide side walls 13, a floor 14 and a ceiling 15, thereby enclosing the substantially cuboid volume and creating a room. In the example, each of the outer sides of the panels is covered by a single steel sheet 16. The sheet 16 is attached along each of its free edges to a respective structural member of the chassis 12. To increase the rigidity of the structure and to facilitate attachment of the sheet 16 to the side walls 13, the floor 14 and the ceiling 15, a fold 16A of each sheet 16 covering a panel extends inwardly between each structural member of the chassis 12 and the adjacent panel. The fold 16A is shown in detail in FIG. 4A. The panels can be formed from any appropriate material or combination of materials, for example steel, glass, timber or plasterboard.

Since the room module 4 is constructed as a series of unbraced frames there is no need for cross bracing (although cross bracing may be provided if required), and therefore the walls 13 of the room module 4 are free from structural obstructions and doors and windows can be located where desired. Appropriate apertures are provided in the panels at the locations of doors and windows. As an alternative to a room module having a chassis or some other framework it is envisaged that the room module may be manufactured from a number of panels which, when linked, provide structural stability to the room module.

Figure 14:
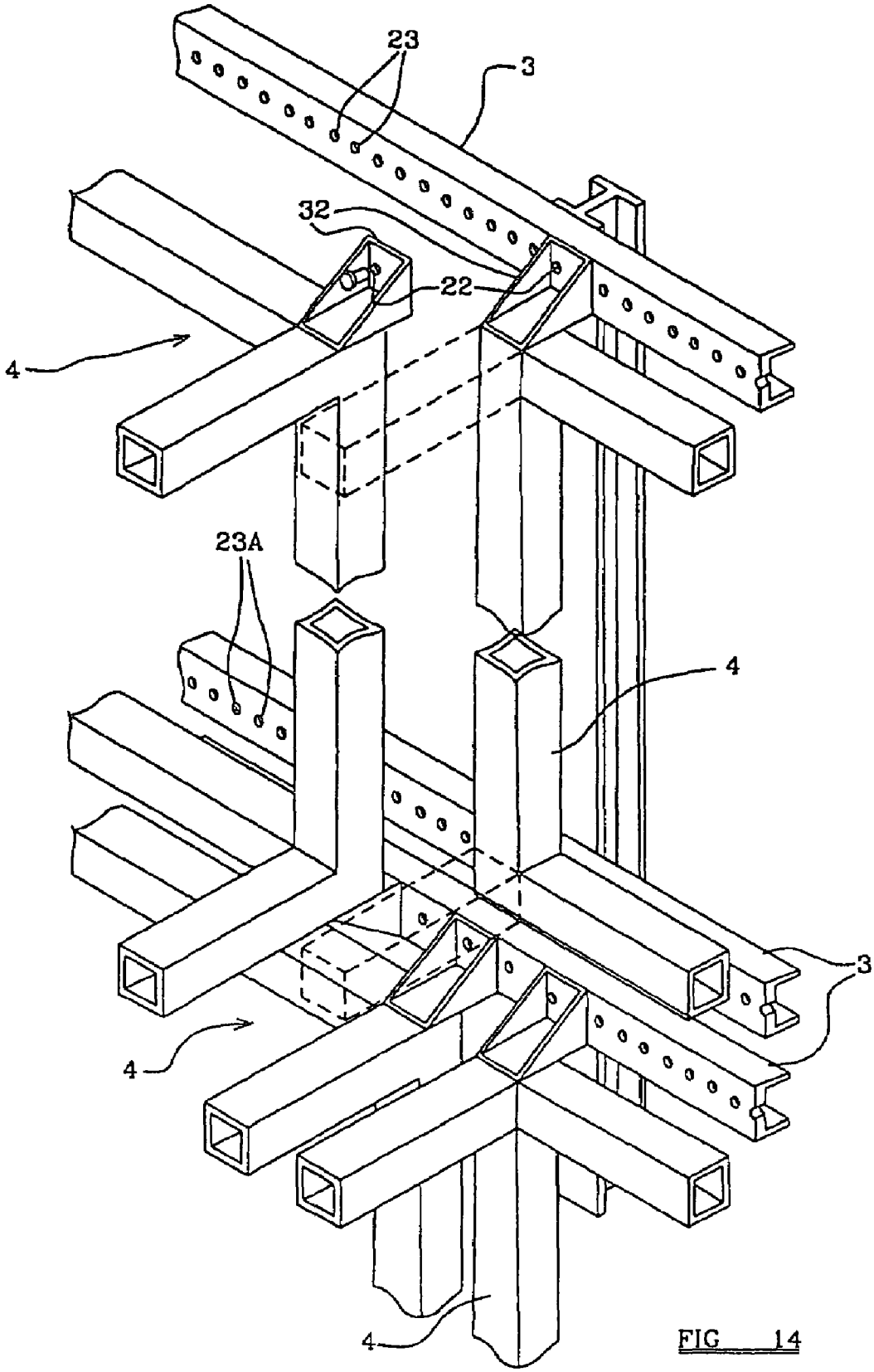
FIG. 14 is a perspective view of an arrangement to enable the attachment of a room module to a support module.

One end of each room module 4 is suitable for attachment to a support module 3. The room module chassis 12 has attachment means to co-operate with the corresponding attachment means provided on the chassis of the support module 3. Preferably, the chassis carries four plates, one in each corner of the room module at the end for attachment to the support module. Referring to FIG. 14, each of the plates has a 2×1 matrix of holes 22 therein which can be aligned with the holes 23, 23A formed in the chassis of the support module. The room module 4 can therefore be docked with the support module 3 and attached thereto by locking bolts passing through the co-operating holes 22, 23(A). This arrangement is also shown schematically in FIG. 1 by the attachment means identified by reference numerals 17.

The room modules 4 are therefore independently attached to the support modules 3. Importantly, the room modules 4 are cantilevered from the support modules 3. Additionally, each room module is spaced apart from its horizontally or vertically neighbouring room module. Further, the room modules 4 on the ground floor are spaced apart from the foundation 2. Thus, each of the room modules 4 is entirely independent of the other room modules 4.

The room modules 4 may, however, be combined with one another, and the wall, floor or ceiling panels removed where the room modules 4 adjoin to create a single large room. Room modules 4 combined in this manner would still be independently removable, and would not be supported by one another. If preferred, not all of each panel need be removed so that, for example, only a doorway between the two room modules 4 may be provided.

Figure 5:
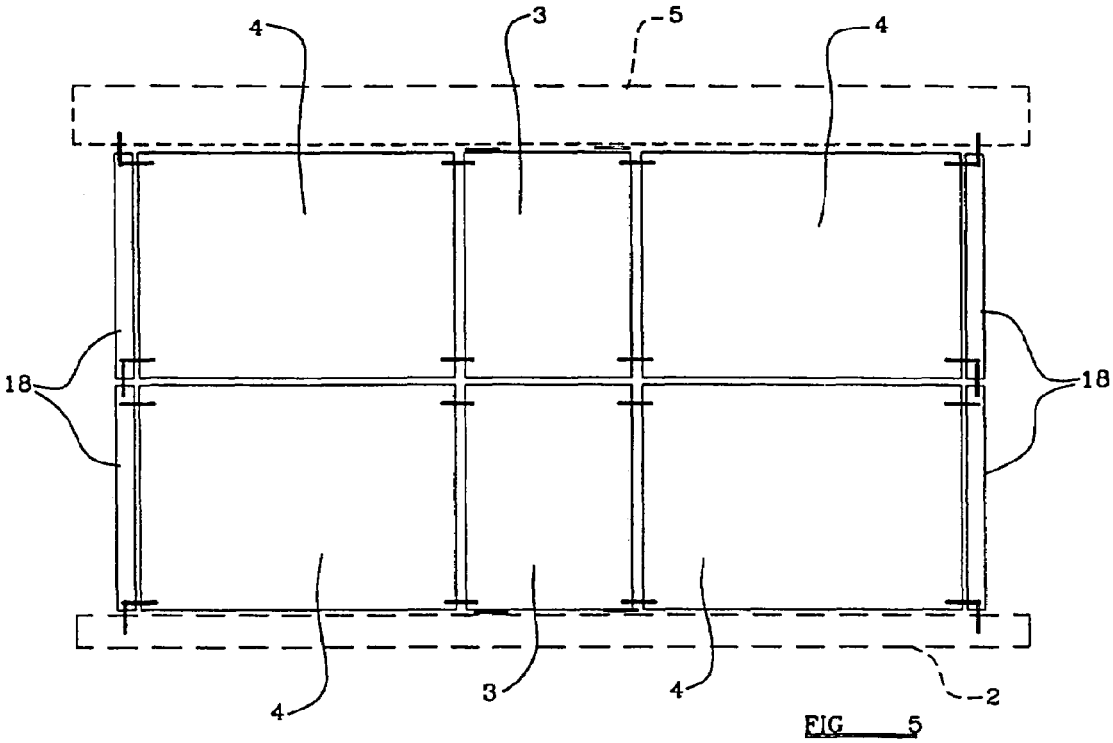
FIG. 5 is a schematic sectional view through a building embodying the present invention.

In the example of FIGS. 1 and 5, The roof structure 5 is envisaged as a plurality of 'volumetric' modules in the form of either a flat roof as in FIG. 5 or a pitched roof as shown in FIG. 1. The roof size, design, configuration and finish can take a number of diverse forms which, apart from affording protection from the weather if required, can be in keeping with the surroundings or which can add to the aesthetic appeal of the building. The roof structure 5 is supported solely by the support module 3' and spans over the room modules cantilevered from either side of the support modules so as to provide cover and protection therefore. Importantly, the room modules 4 on the top floor of the building 1 adjacent the roof structure 5 are spaced apart from the roof structure 5.

If the design of the roof allows, as does the pitched roof in the example of FIG. 1, it is possible to house a further room module 4 in the roof structure 5.

Whilst the roof structure 5 can provide a certain amount of protection from weather, more protection may be required especially if the building is not located in a temperate climate. Turning to FIG. 5, in this example a cladding or 'rainscreen' material 18 is provided around the building, in particular the room modules 4. In a similar manner to the roof structure 5 the cladding can again take a number of diverse forms which can be in keeping with the surroundings or which can add to the aesthetic appeal of the building. For example, the cladding 18 can be, as shown in FIG. 5, a plurality of demountable panels which are bolted each other, to the foundation 2, to the roof structure 5 and to the room modules 4. The panels may be of glass, timber, metal or any other suitable form of protective or aesthetic cladding. In the example, the cladding 18 is supported by the foundation 2, which extends sufficiently far from the support module 3 to do so.

It should be noted that the cladding 18 need not assist in the supporting of the room modules 4 which are cantilevered from and fully supported by the support modules 3. The securing, preferably by bolting, of the cladding 18 to the room modules 4 may, however, serve to transmit wind loads experienced by the cladding 18 back to the load bearing support modules 3. This arrangement also ensures that any apertures on the outward facing sides of the room modules 4 are aligned with corresponding apertures formed in the cladding 18.

It is recognised that an external framework comprising the cladding or in addition to the cladding could be provided to give additional support to the free end of each room module. The room modules would then be provided as a propped cantilever structure from the support module. As an example, this may be desirable when the 'live' load of a room module (i.e. when it is in use by the inhabitants of the building) is likely to be significantly greater than the 'dead' load of the room module.

Figure 6:
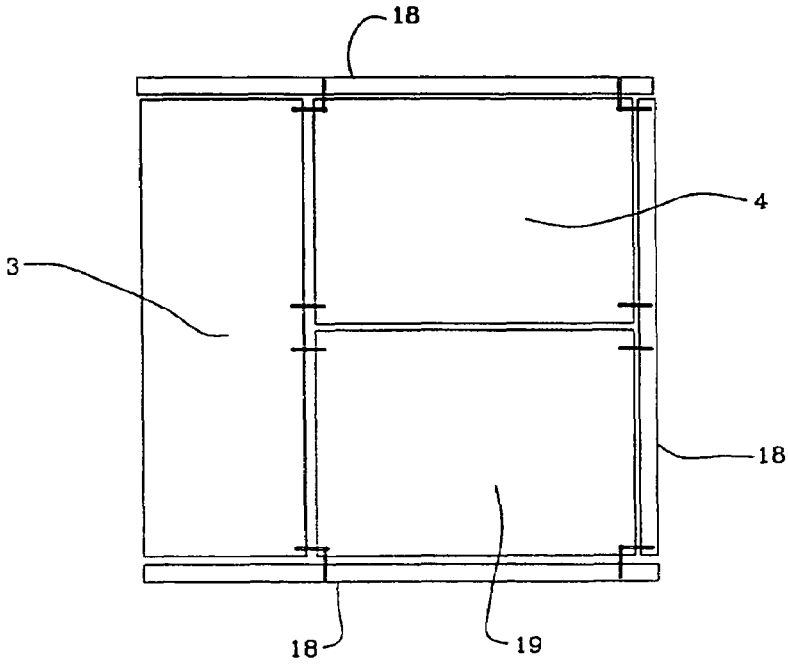
FIG. 6 is a schematic plan view of a part of a building embodying the present invention.

FIG. 6 shows an embodiment of the building which comprises a single support module 3, a room module 4 and a spacer module 19. The spacer module 19 is simply a cross-braced framework which can be used to fill 'voids' in the building thereby maintaining the desired line of the cladding, while providing a structure to transfer any wind loads back to the support module 3.

It is envisaged that the support modules will provide the principal route for all the services in the building to the room modules. The services would include (but are not limited to) water, gas, electricity, telecommunications, air-conditioning, heating ducts or central heating, vacuum pressure, computer network cabling and video and audio feeds. The services are hidden behind the demountable wall panels and in the voids between any adjoining modules. Preferably, the services will be available to each room module attachable to a support module, services on the support module being connectable to co-operating services on a room module. Further, it is envisaged that the incoming services will be provided to the building through the support module 3. For example, the supplies of electricity, water or gas would be located in or connected to the ground floor support module 3.

Buildings embodying the present invention particularly lend themselves to being readily and quickly constructed with little skill being required during final assembly on site. It is envisaged that all of the modules comprising a building will be able to be bought as stand alone items from separate, specialist suppliers. Each of the room modules is intended to be a fully finished room having the appropriate fixtures and fittings such as power points, light fittings, windows, doors, kitchen units, bathroom suites, toilets, sinks and the like and also incorporating furniture where appropriate.

Figure 7:
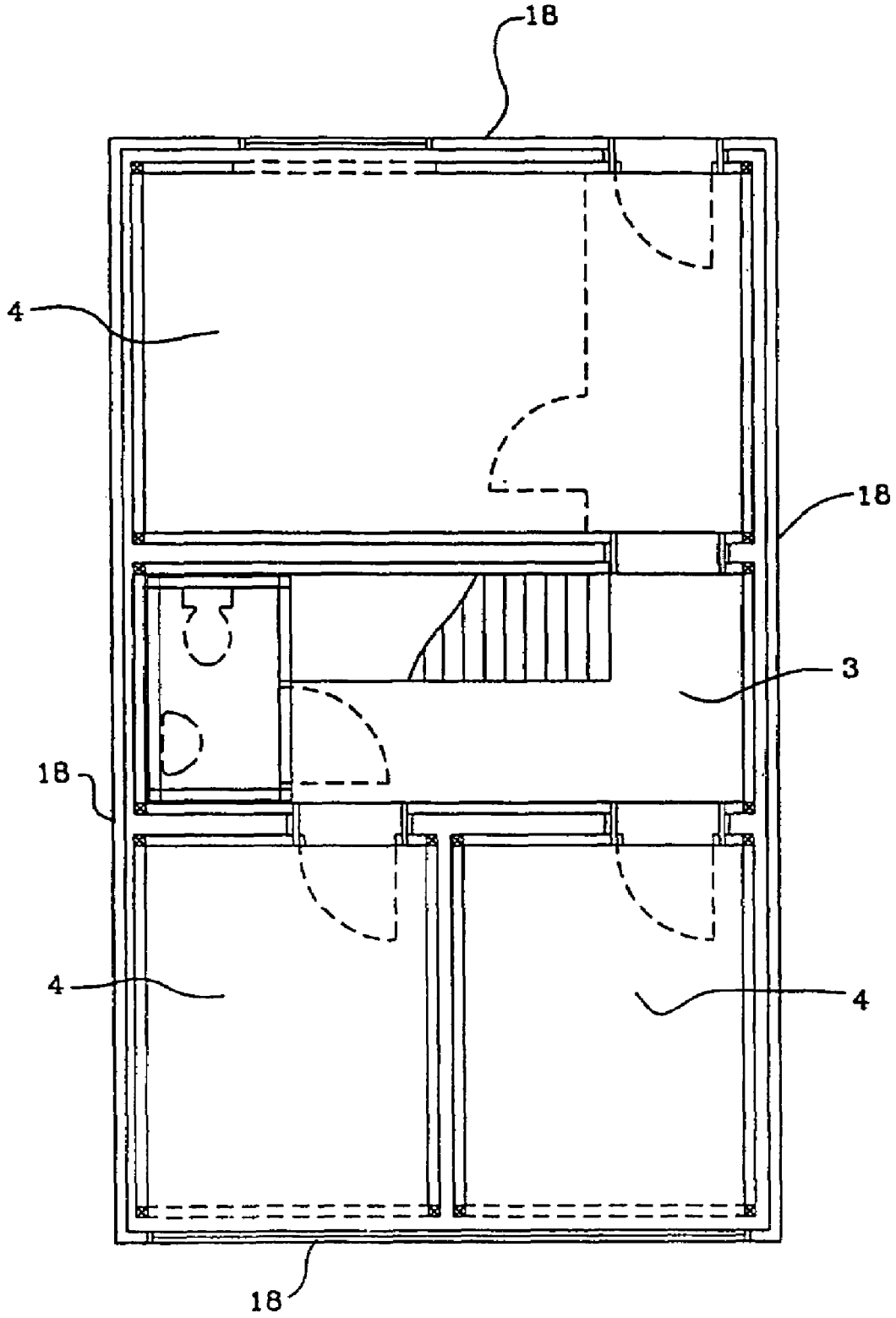
FIG. 7 is a plan view of the ground floor of the building of FIG. 1.
Figure 8:
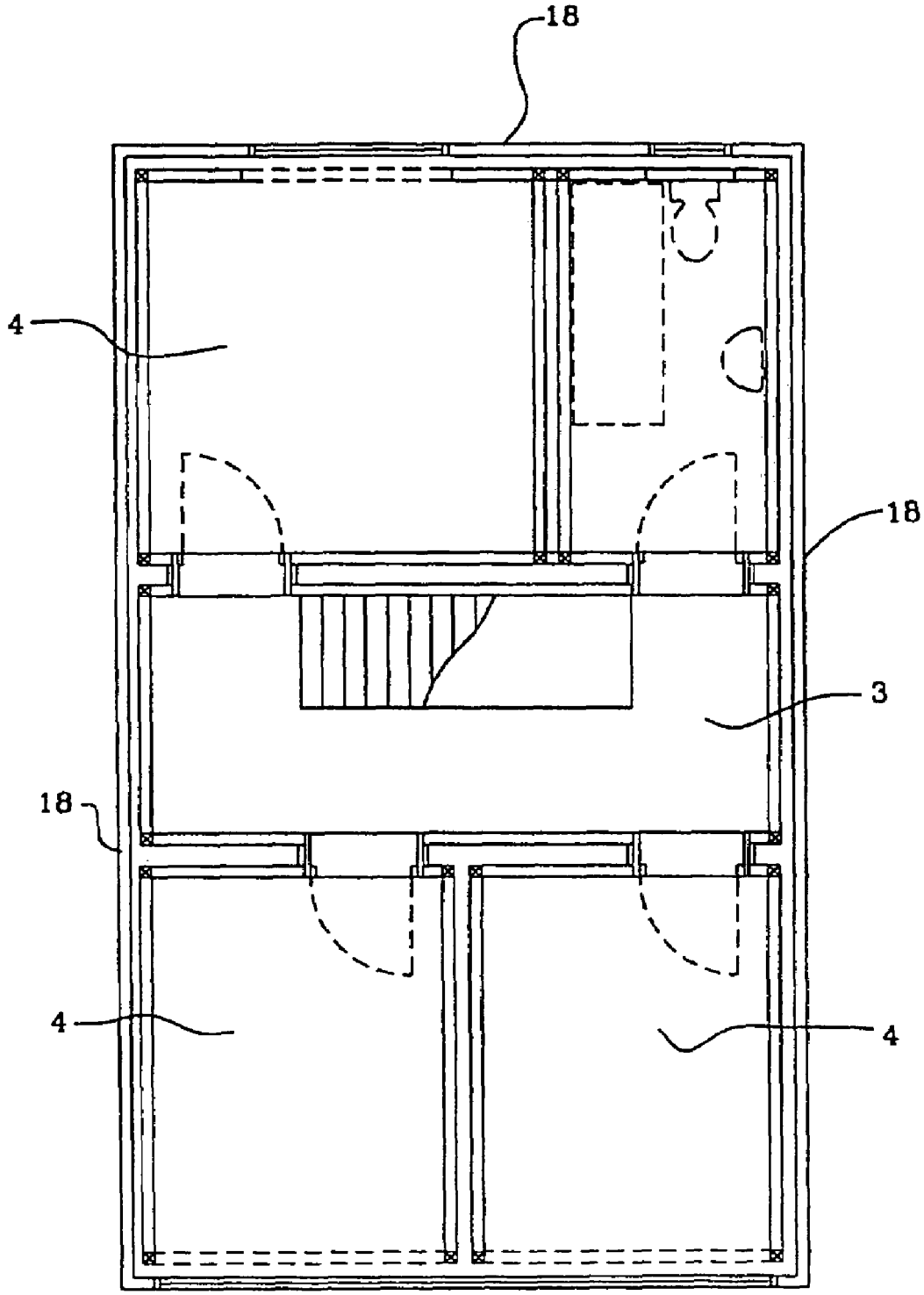
FIG. 8 is a plan view of the first floor of the building of FIG. 1.

Thus, referring to the specific example shown in FIGS. 7 and 8, one could purchase two support modules 3, a kitchen room module 4, a living room module 4, a dining room module 4, three bedroom room modules 4, and a bathroom room module 4 all directly from separate, specialist suppliers to construct a basic three bedroom house. Assuming that a foundation 2 is in place, the building is readily assembled by bolting the room modules to the support modules. An appropriate roof structure and cladding could then be added if desired. In temperate regions, only a minimal, if any, roof structure and cladding may be required.

If the homeowner could not afford or did not need two of the bedrooms, for example bedrooms 2 and 3, then the homeowner could purchase a single spacer module 19 to take the place of the two bedroom room modules 4. When the home owner can afford or requires further bedrooms, then, since the spacer module 19 is independently cantilevered from the support module 3, it can simply be removed and replaced by two bedroom room modules. Thus, the building is so adaptable that the occupier of a house embodying the invention can simply decide to add, remove or rearrange rooms as and when required. Similarly, if the bathroom is to be upgraded, then it is envisaged that the old bathroom room module would simply be exchanged for a higher specification version.

If a further floor is required to the building, then a further support module 3 can be purchased, the roof structure 5 removed and the new support module 3 stacked on the existing support modules 3. Additional room modules 4 can then be attached to the new storey and the roof structure 5 replaced. One could even envisage room modules on one side of a building being exchanged with those on the other side of the building simply to change the aspect of a particular room.

Thus, it can be appreciated that housing embodying the present invention can be designed to meet the needs of a variety of households and be readily capable of conversion or expansion.

Figure 9:
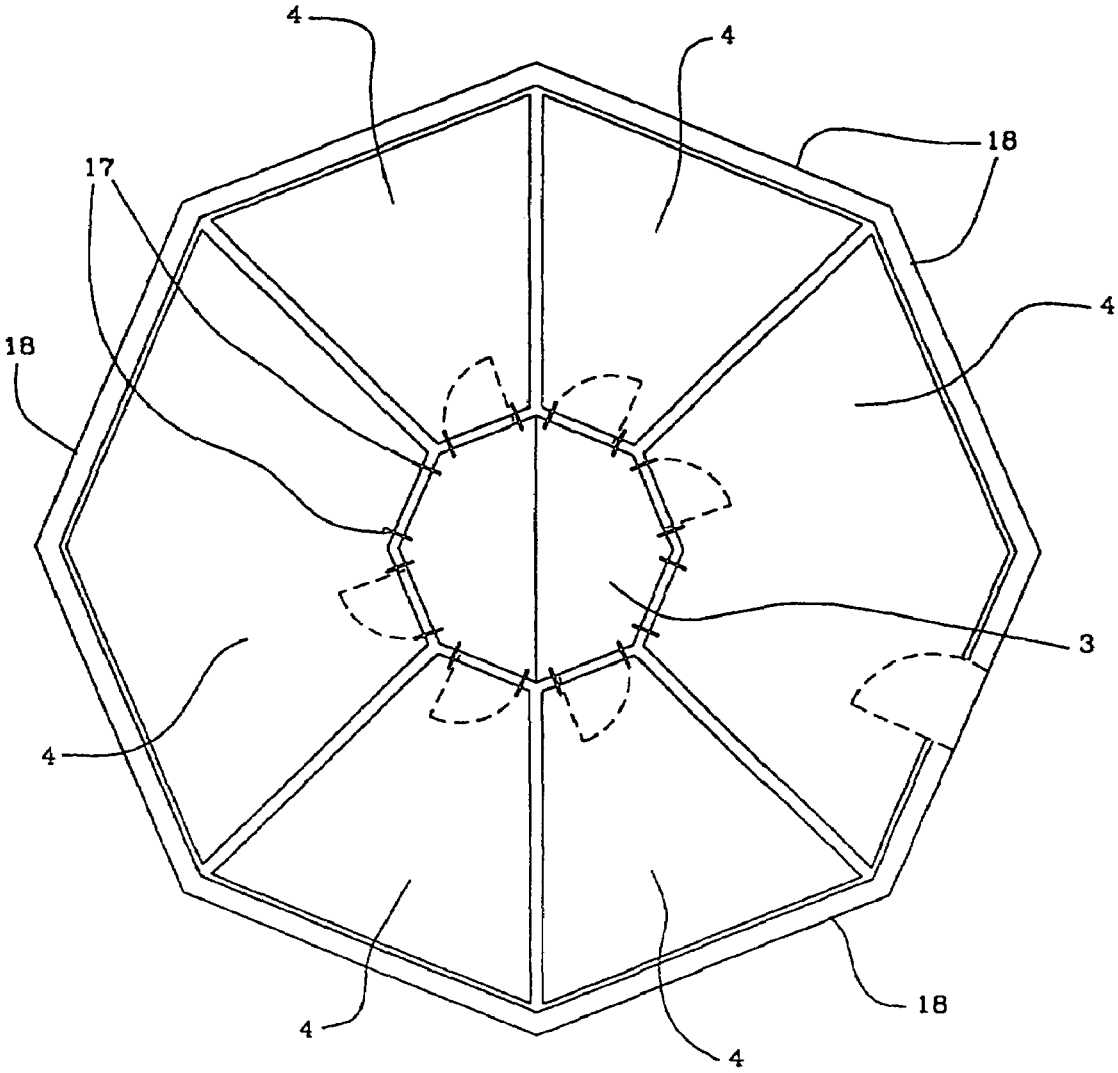
FIG. 9 is a schematic plan view of a building embodying the present invention.

FIG. 9 shows a plan view of one floor of another building embodying the invention. In this example, the support module 3 is octagonal in form. Of course, other polygonal room or support modules may be used.

Figure 10:
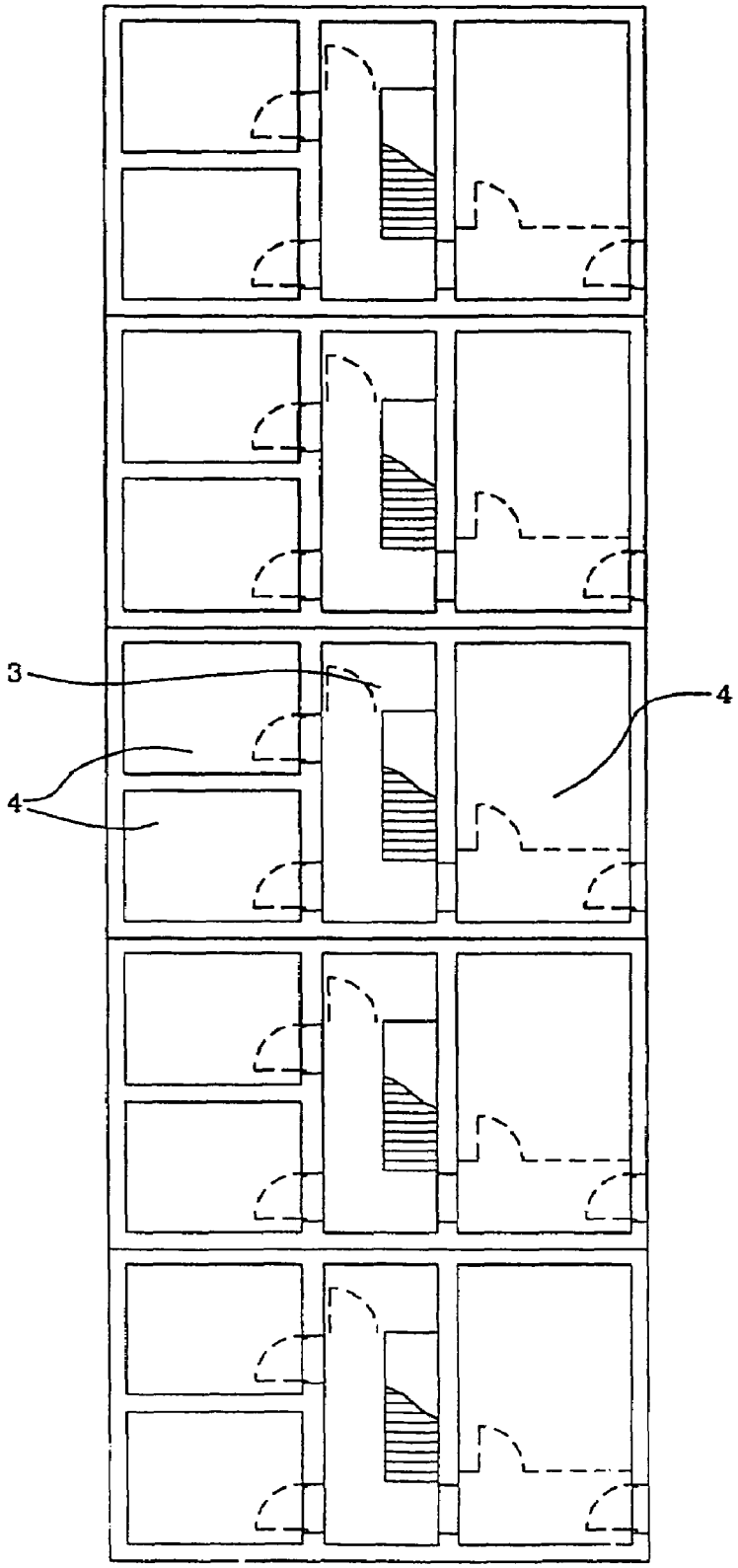
FIG. 10 is a plan view of a plurality of buildings embodying the present invention arranged in a terrace configuration.

FIG. 10 shows a way in which houses embodying the invention can be aligned with one another, so as to provide a terrace of buildings, by aligning the support modules 3 of the respective buildings adjacent to one another.

Figure 11:
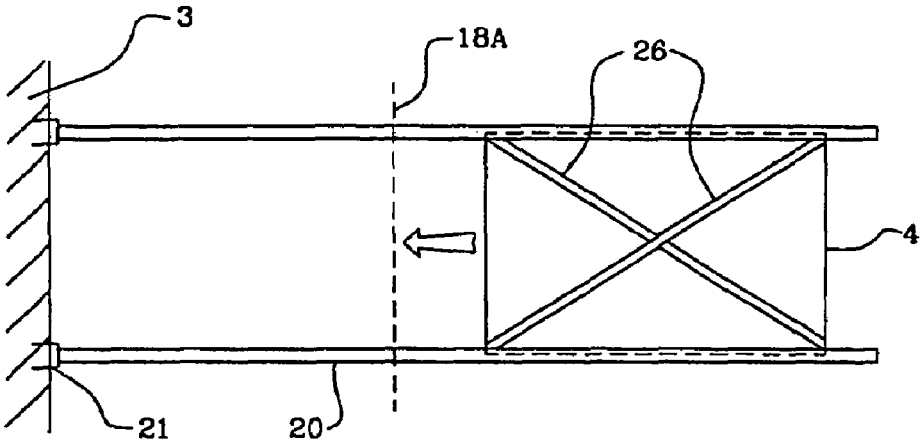
FIG. 11 is a schematic plan view of a room module being fitted to a support module.
Figure 12:
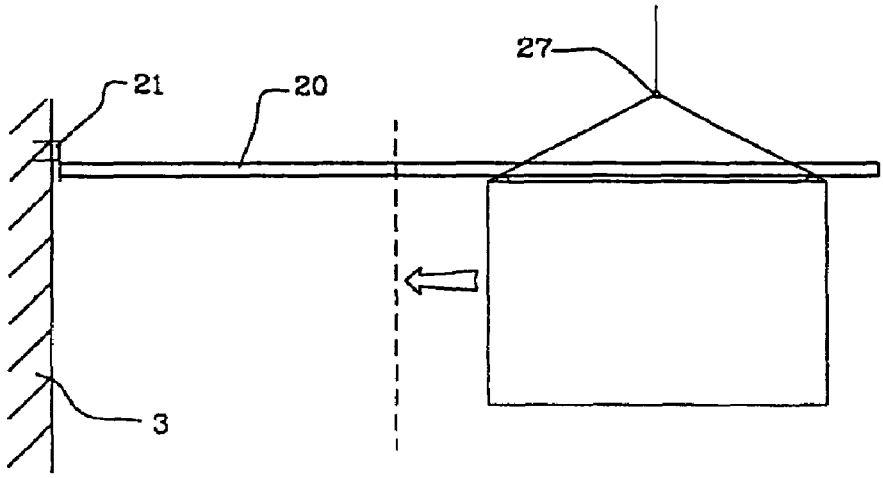
FIG. 12 is a schematic sectional view of the arrangement of FIG. 11.
Figure 13:
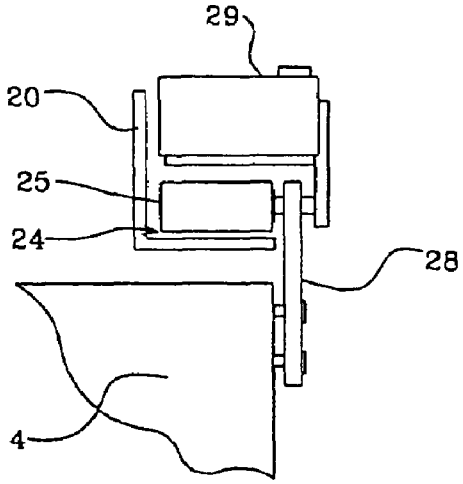
FIG. 13 is a schematic detail of a rack and pinion drive from FIG. 12.

It is clearly desirable to remove or insert room modules 4 in an existing building without disturbing or requiring the removal of either horizontally or vertically adjacent room modules. It is envisaged that buildings embodying the present invention will incorporate room modules which are spaced apart from one another, the roof structure and the foundation so as to be easily and independently removable. A particularly preferred method of attaching a room module 4 to (or removing from) a support module is shown in FIGS. 11 to 13. A pair of rigid steel rails 20 each fitted with an orthogonally arranged plate 21 at one end are provided. The plates are similar to those found at the attachment end of a room module 4. Each rail 20 is attached by its plate 21 to the support module 4 at a position immediately above the intended site of one of the upper corners of the room module 4 to be attached. FIG. 14 schematically shows the attachment holes 23 provided for the plates 21 on the support module 3.

The row of arrays of holes 23 are intended to be locked to corresponding attachment means provided on the top corners of the room modules 4. The row of arrays of holes 23A at the base of the support module 3 are intended to be locked to corresponding attachment means provided on the bottom corners of the room modules 4.

When in position, the rails 20 extend past the line 18A of the cladding 18 so as to allow a room module to be held under the rails 20 outside the perimeter of the building.

A room module is connected to the rails, and a crane or other convenient lifting means is attached to the rails and used to lift the room module 4. Preferably, as shown in FIG. 13, the rails 20 carry a rack 24 and the four ceiling corners of the room module 4 are each connected to a pinion wheel 25. The pinion wheels 25 on the corners of the room module are held by the racks 24 so as to allow the room module 4, attached to the pinion wheels 25 by vertical supports 28, to be driven along underneath the rails 20 toward the support module 3 in a controlled manner by the rack and pinion drive. The driving force to turn the pinion wheels 25 is provided by respective individual motors 29 which each drive a respective pinion wheel 25 and are mounted thereto. The room module 4 can therefore be presented to the support module 3 with the attachment plates on the room module aligning with their respective arrays of holes 23, 23A on the support module 3 for locking thereto. Once the room module 4 has been secured to the support module 3, the rails 2Q can be released from the support module 3 and removed by the crane.

For added strength and rigidity, the rails may be cross-braced near the end furthest from the support module by a pair of hinged diagonal struts 26, as shown in FIG. 11, which allow the pair of rails to be spaced apart by a desired distance equivalent to the width of the relevant room module 4.

In a preferred embodiment of the method of attaching a room module 4, the rails 20 are first located on the pinion wheels 25 and the entire assembly of rails 20 and room module 4 is craned into position to allow the rails 20 to be attached to the support module 3 for subsequent presentation of the room module 4 to the support module 3. This method removes the need for the room module 4 to be engaged with the rails 20 when the rails 20 are already secured to the support module.

It is however recognised that, when constructing a new building and given sufficient access, it could be advantageous to present the room module 4 to the support module 3 using traditional lifting methods such as (but not limited to) a crane 27 or forklift truck.

Since the room modules 4 are spaced apart from one another, both vertically and horizontally, from the roof structure 5 and from the foundation 2, the above described method can be used to remove or add room modules 4 irrespective of their location around the support module 3. Room modules 4 can thus be added or removed in any order as the room modules are entirely independent of one another.

FIG. 14 shows room modules 4 attached to the chassis of a support module 3. The horizontal members at the top and bottom of the chassis of the support module 3 contain rows of arrays of holes 23, 23A as previously mentioned. Securing elements 32 are connected to or form part of the corners of the upper and lower members of the chassis of the room modules 4. Each securing element 32 comprises two plates secured together at right angles to one another and braced by triangular plates. The securing elements 32 present the face of one of the plates to the chassis of the adjacent support module 3, which plate contains the 2×1 array of holes 22. The room module 4 is attached to the support module 3 by a bolt passing through each of the 2×1 array of holes 22 and through one of the holes 23, 23A in the chassis 12 of the support module 3.

Figure 15:
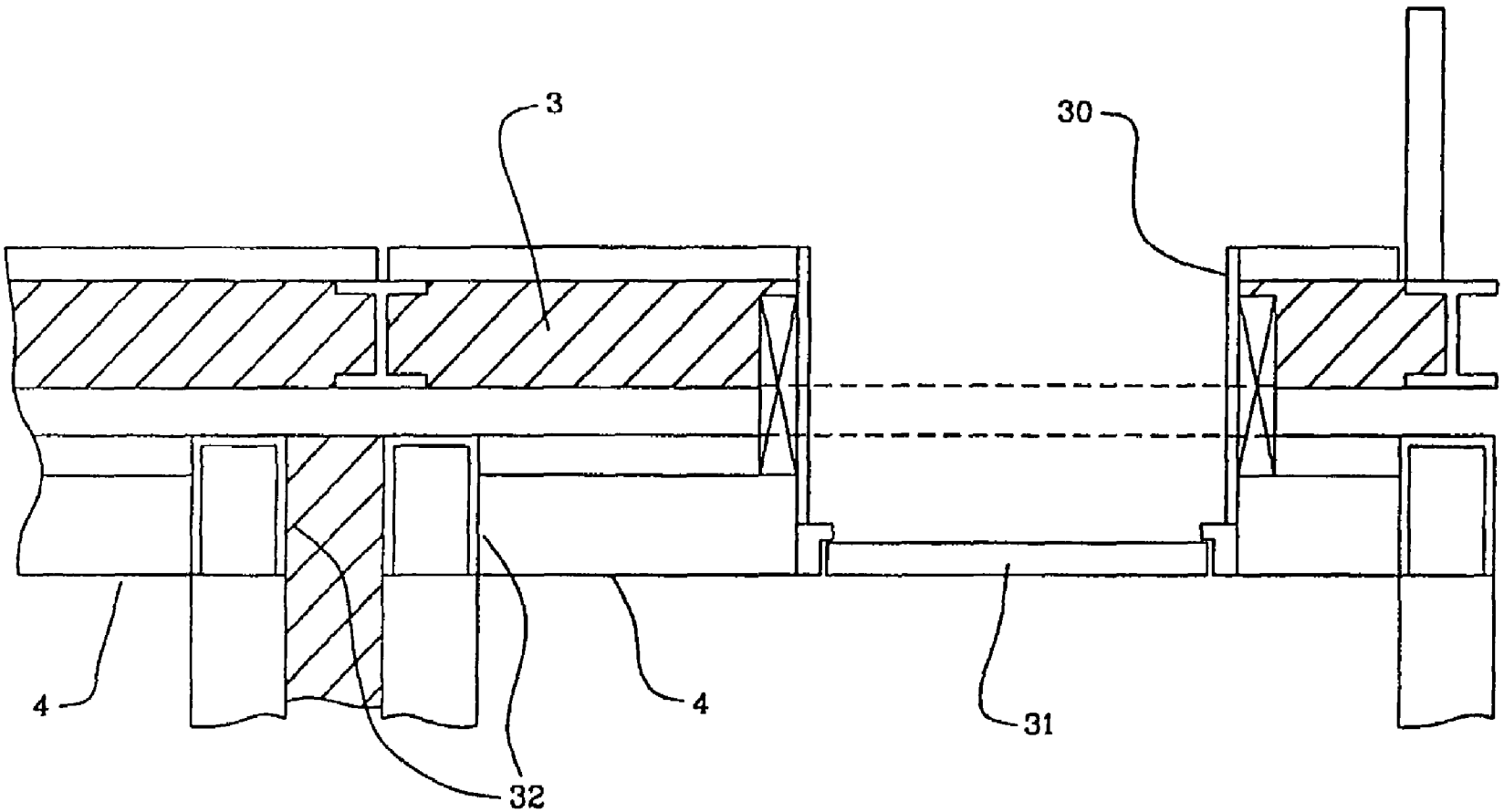
FIG. 15 is a schematic plan view of a support module attached to two room modules.

FIG. 15 shows a plan view of two room modules 4 attached to a support module 3 in the manner described in relation to FIG. 14. Co-operating apertures in the wall and surrounding panels of the support module and the adjacent wall of the room module provide a doorway between the support module 3 and the room module 4. Cover plates 30 are provided to line the doorway, bridging the space between the room module 4 and the support module 3. The room module 4 is provided with a door 31 which is attached with hinges to the door frame to open inwards into the room module 4.

Figure 16:
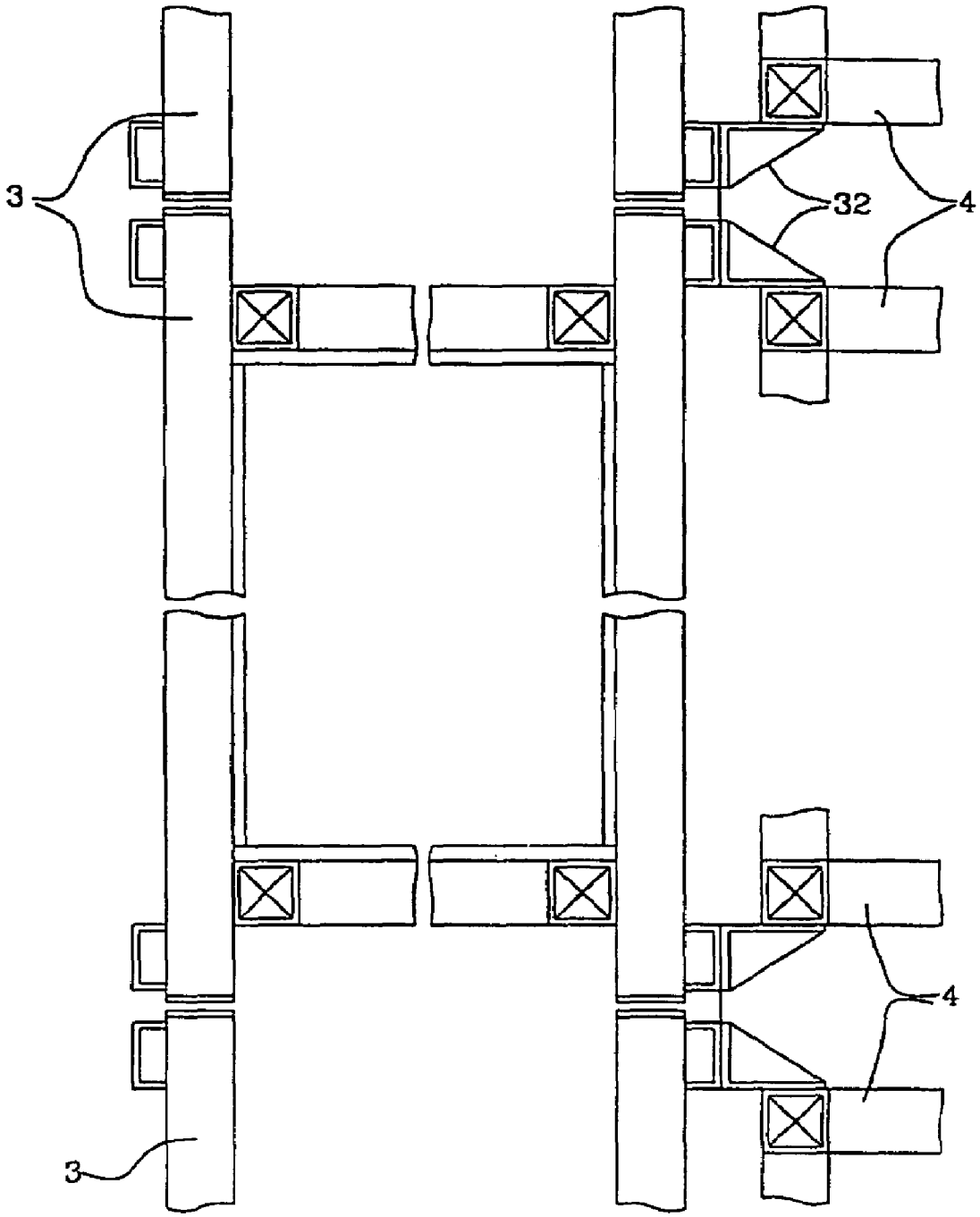
FIG. 16 is a schematic sectional view of three room modules attached to respective support modules.

FIG. 16 shows a sectional view of three support modules 3 stacked on top of one another. Room modules are attached to the right hand side of each of the support modules 3 in the manner described above, with securing elements 32 fixing the chassis of the room modules 4 to those of the support modules 3.

Figure 17:
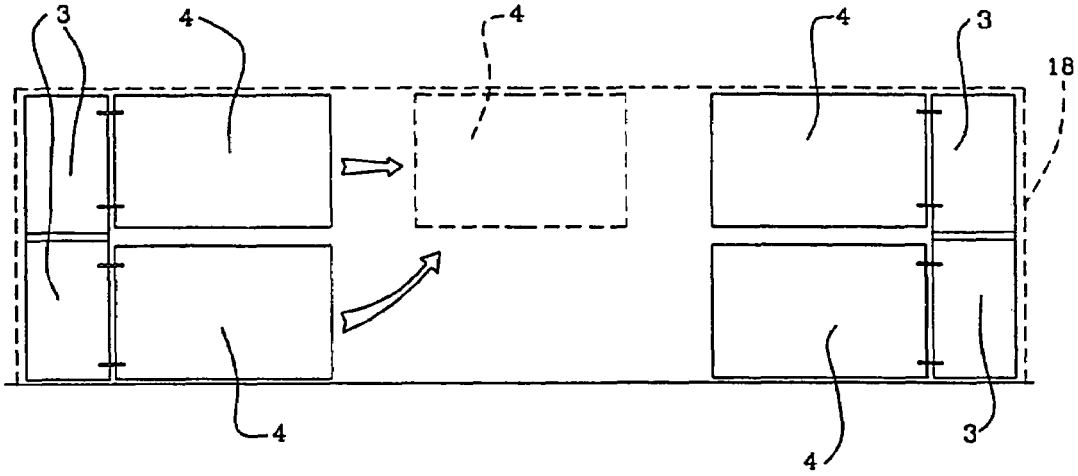
FIG. 17 is a schematic sectional view through a building structure embodying the present invention.
Figure 18:
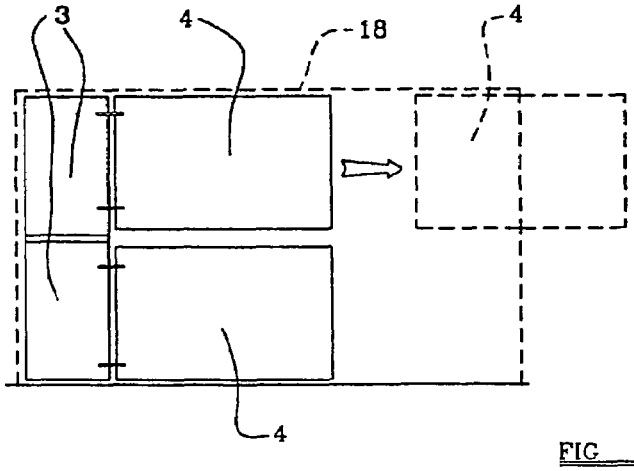
FIG. 18 is a schematic sectional view through another building structure embodying the present invention.

The envelope may also have additional properties such as thermal and acoustic properties which would depend on the type of building and its location. It is envisaged that the cladding may be spaced apart from the room modules, to create an enclosed space around the room modules, as shown in FIGS. 17 and 18. For example, this configuration could be suitable for prisons, where the room modules 4 could form individual cells and the enclosed space formed by the cladding 18 would be a secure, enclosed area in which prisoners and staff could circulate. More than one gang of support modules 3, each carrying several 'cell' room modules, could be enclosed within the same envelope. It is also envisaged that there would be sufficient space within the cladding structure to allow room modules 4 to be added or removed within the cladding structure without needing the cladding structure to be dismantled if so desired.

FIGS. 17 and 18 show two configurations of a prison layout. FIG. 17 involves a single cladding enveloping two gangs of support modules 3, each with their own room modules 4. Sufficient space is provided within the cladding to remove any of the room modules 4 into the central space between the two pairs of structures, and a room module 4 is shown in phantom to demonstrate this. FIG. 18 shows a prison layout in which the cladding 18 only surrounds one support module 3, but extends beyond the edge of the room modules attached thereto to provide a sizeable enclosed space. In this example, the cladding would need to be removed if a room module 4 is to be extracted from within the cladding.

Thus, buildings embodying the invention are extremely versatile having a flexible size, design and configuration. Further, such buildings have rooms which are replaceable and can therefore be readily upgraded to a higher specification or their functionality changed. Buildings embodying the invention present an entirely new concept in the supply and production of buildings, allowing the basic building parts to be readily sourced and easily constructed in a modular manner without the need to involve many different tradesmen and skilled labourers on-site in the production of a building.

It is to be appreciated that the claimed invention is not limited in its application to residential housing but is equally applicable to other building structures such as hospitals, hotels, offices, shops and the like.

What is claimed is:

1. A building structure comprising:

a support module having attachment means for attaching a room module to support module; and a plurality of enclosed room modules each of which is independently attachable to and cantilevered from the support module;

each attachment means on the support module comprising an array of spaced apart attachment locations provided along a chassis member of the support module, each of which attachment locations being suitable for co-operation with and attachment to corresponding attachment means provided on a room chassis of a room module, the position of attachment of the room module with respect to the support module being variable by attaching the room module at different locations along the chassis member of the support module.

2. A building structure according to claim 1, wherein the support module supports one room module adjacent another, the room modules being horizontally spaced apart from one another.

3. A building structure according to claim 1, wherein each room module is spaced apart from an adjoining room module.

4. A building structure according to claim 1, wherein a cladding is provided around the building structure.

5. A building structure according to claim 4, wherein the cladding is attached to and supported by a foundation.

6. A building structure according to claim 4, wherein the cladding is attached to and supported by a roof structure.

7. A building structure according to claim 4, wherein the cladding is attached to and supported by at least one room module.

8. A building structure according to claim 4, wherein the cladding comprises a plurality of demountable panels.

9. A building structure according to claim 1, wherein the support module supports a roof structure which covers the support module and each room module, the roof structure being spaced apart from the support and room modules.

10. A building structure according to claim 9, wherein the roof structure includes a room module.

11. A building structure according to claim 1, wherein a foundation structure underlies the support module, the foundation structure being spaced apart from the room modules and has a main portion upon which the support module sits and one or more stabilizing portions extending from the main portion, wherein the foundation structure is manufactured as a precast concrete structure.

12. A building structure according to claim 11, wherein the or each stabilizing portion underlies one or more room modules and is spaced apart from the room modules and comprises a frame of foundation material having an outer perimeter, the center of the frame being a void.

13. A building structure according to claim 11, wherein one or more piles extend from the foundation structure into the underlying ground.

14. A building structure according to claim 1, wherein the room chassis defines a volume, and wherein the room chassis is constructed from one or more upper and lower members connected rigidly by upright members but not braced by diagonal members, the rigidity of the room chassis being secured by rigidity at the chassis joints, and wherein panels are provided between the members of the room chassis to provide side walls, a floor and a ceiling.

15. A building structure according to claim 1, wherein a room module includes one or more internal partitions to define one or more rooms in each room module.

16. A building structure according to claim 1, wherein a room module includes at least one door aperture and/or at least one window aperture.

17. A building structure according to claim 1, wherein the attachment means comprise a plurality of holes formed in the support chassis of the support module and the room module, the holes being alignable to receive therethrough a locking bolt to secure the room module to the support module.

18. A building structure according to claim 1, wherein the support module includes a circulation passage having access to each room module attached thereto.

19. A building structure according to claim 1, wherein a further support module is attachable on top the support module to provide a further story to the building structure.

20. A building structure according to claim 1, wherein a further support module is attachable adjacent the support module to provide a plurality of support members in side by side engagement.

21. A building structure according to claim 1, wherein the services for the building are principally routed through the support module, thereby facilitating the connection of services to each room module attached to or attachable to the support module, and wherein each room module has services fitted in preparation for connection to corresponding services on the support module.

22. A building structure according to claim 1, wherein the support module has demountable wall panels, the wall panels being blank panels for walls of the support module which do not require an aperture therein and wall panels having an aperture therein for walls of the support module which do require an aperture therein, an aperture in a wall panel of the support module being alignable with an aperture in a wall panel of a room module.

23. A kit for building a building structure, comprising:

a support module having attachment means for attaching a room module to the support module; and a plurality of enclosed room modules, each room module being independently attachable to the support module such that it is cantilevered therefrom, and each attachment means on the support module comprising an array of spaced apart attachment locations provided along a chassis member of the support module, each of which attachment locations being suitable for co-operation with and attachment to corresponding attachment means provided on a room chassis of a room module, the position of attachment of the room module with respect to the support module being variable by attaching the room module at different locations along the chassis member of the support module.

24. The structure of claim 1 wherein the attachment means functions to lock together a room module and the support module.

25. The structure of claim 1 wherein the attachment means functions to bolt together a room module and the support module.

* * * * *